US010107075B2

(12) United States Patent
Grayson et al.

(10) Patent No.: US 10,107,075 B2
(45) Date of Patent: Oct. 23, 2018

(54) DOWNHOLE ISOLATION VALVE

(71) Applicant: Weatherford Technology Holdings, LLC, Houston, TX (US)

(72) Inventors: Michael Brian Grayson, Sugar Land, TX (US); Julmar Shaun Sadicon Toralde, Katy, TX (US); Joe Noske, Houston, TX (US); Christopher L. McDowell, New Caney, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 322 days.

(21) Appl. No.: 15/079,865

(22) Filed: Mar. 24, 2016

(65) Prior Publication Data

US 2016/0281465 A1 Sep. 29, 2016

Related U.S. Application Data

(60) Provisional application No. 62/137,565, filed on Mar. 24, 2015.

(51) Int. Cl.
*E21B 34/00* (2006.01)
*E21B 34/10* (2006.01)
(Continued)

(52) U.S. Cl.
CPC ..... *E21B 34/101* (2013.01); *E21B 23/04* (2013.01); *E21B 34/00* (2013.01); *E21B 34/102* (2013.01);
(Continued)

(58) Field of Classification Search
CPC .... E21B 2034/005; E21B 34/10; E21B 34/14; E21B 34/101; E21B 23/04; E21B 34/102; E21B 34/00
See application file for complete search history.

(56) References Cited

U.S. PATENT DOCUMENTS 4,664,195 A 5/1987 Deaton
4,951,753 A 8/1990 Eriksen
(Continued)

FOREIGN PATENT DOCUMENTS

GB 2424435 9/2006
WO 99/31352 A2 6/1999
(Continued)

OTHER PUBLICATIONS

Extended European Search Report dated Feb. 10, 2017, for EP Patent Application No. 16162187.5, 10 pgs.
(Continued)

*Primary Examiner* — Daniel P Stephenson
(74) *Attorney, Agent, or Firm* — Patterson + Sheridan, LLP

(57) ABSTRACT

An isolation valve for use with a tubular string includes a tubular housing for connection with the tubular string. A closure member is disposed in the housing and movable between an open position and a closed position. A flow tube is longitudinally movable relative to the housing for opening the closure member. A piston is coupled to the flow tube for moving the flow tube, and a fluid chamber is formed between the flow tube and the housing and receiving the piston. The isolation valve having a first fluid passage for fluid communication between a first portion of the chamber and a control line for moving the piston in a first direction, and a second fluid passage for fluid communication between a second portion of the chamber and a bore of the tubular string for moving the piston in a second direction.

20 Claims, 10 Drawing Sheets

(51) Int. Cl.
*E21B 23/04* (2006.01)
*E21B 34/14* (2006.01)

(52) U.S. Cl.
CPC ..... *E21B 34/14* (2013.01); *E21B 2034/005* (2013.01)

(56) References Cited

U.S. PATENT DOCUMENTS 5,094,294 A 3/1992 Bayh
5,271,462 A * 12/1993 Berzin ..... E21B 33/1243 166/122
5,411,096 A * 5/1995 Akkerman ..... E21B 34/10 166/321
5,415,237 A * 5/1995 Strattan ..... E21B 33/0355 166/324
6,003,605 A * 12/1999 Dickson ..... E21B 34/10 166/324
7,363,980 B2 * 4/2008 Pringle ..... E21B 23/006 166/319
8,151,889 B2 * 4/2012 Biddick ..... E21B 34/10 166/332.8
8,662,187 B2 * 3/2014 Lake ..... E21B 34/066 166/332.8
2003/0155131 A1 * 8/2003 Vick, Jr. ..... E21B 23/04 166/375
2006/0021757 A1 2/2006 Patel
2006/0157255 A1 7/2006 Smith
2007/0068680 A1 3/2007 Vick
2016/0138365 A1 * 5/2016 Vick, Jr. ..... E21B 34/14 166/375
2016/0281465 A1 * 9/2016 Grayson ..... E21B 34/00

FOREIGN PATENT DOCUMENTS

WO 01/12950 A1 2/2001
WO 2014189494 A1 11/2014

OTHER PUBLICATIONS

Canadian Office Action dated Apr. 10, 2017, for Canadian Patent Application No. 2,924,942, 3 pages.
Canadian Office Action dated Jan. 24, 2018, for Canadian Patent Application No. 2,924,942.
EPO Office Action dated Feb. 7, 2018, for European Application No. 16162187.5.

* cited by examiner 411
467
465l
465
465u
460
462
458u
466
470
458l
408
450
465l
462
490
481
480
465u
483
435
459
434
415
452

DOWNHOLE ISOLATION VALVE

BACKGROUND OF THE DISCLOSURE

Field of the Disclosure

The present disclosure generally relates to a downhole isolation valve and use thereof.

Description of the Related Art

A wellbore is formed to access hydrocarbon bearing formations, e.g. crude oil and/or natural gas, by the use of drilling. Drilling is accomplished by utilizing a drill bit that is mounted on the end of a drill string. To drill the wellbore, the drill string is rotated by a top drive or rotary table on a surface platform or rig, and/or by a downhole motor mounted towards the lower end of the drill string. After drilling a first segment of the wellbore, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. In some instances, the casing string is not cement and retrievable. The combination of cement and casing strengthens the wellbore and facilitates the isolation of certain areas of the formation behind the casing for the production of hydrocarbons.

An isolation valve assembled as part of the casing string may be used to temporarily isolate a formation pressure below the isolation valve such that a portion of the wellbore above the isolation valve may be temporarily relieved to atmospheric pressure. Since the pressure above the isolation valve is relieved, the drill/work string can be tripped into the wellbore without wellbore pressure acting to push the string out and tripped out of the wellbore without concern for swabbing the exposed formation.

SUMMARY OF THE DISCLOSURE

In one or more of the embodiments described herein, a single control line may be used to operate the isolation valve between an open position and a closed position.

In one embodiment, an isolation valve for use with a tubular string includes a tubular housing for connection with the tubular string; a closure member disposed in the housing and movable between an open position and a closed position; a flow tube longitudinally movable relative to the housing for opening the closure member; a piston for moving the flow tube; a hydraulic chamber formed between the flow tube and the housing and receiving the piston; a first hydraulic passage for fluid communication between a first portion of the chamber and a control line and for moving the piston in a first direction; and a second hydraulic passage for fluid communication between a second portion of the chamber and a bore of the tubular string and for moving the piston in a second direction.

In another embodiment, a method of operating an isolation valve includes deploying a casing string equipped with an isolation valve, wherein the isolation valve includes a piston for moving a flow tube to open or close the closure member; fluidly communicating a first side of the piston with a pressure in a control line; fluidly communicating a second side of the piston with a pressure in the casing string; and moving the flow tube to open the closure member.

In another embodiment, an isolation valve for use with a tubular string includes a tubular housing for connection with the tubular string; a closure member disposed in the housing and movable between an open position and a closed position; a flow tube longitudinally movable relative to the housing for opening the closure member; a hydraulic chamber formed between the flow tube and the housing; a piston for moving the flow tube, wherein the piston separates the chamber into a first portion and a second portion; a piston bore for selective fluid communication between the first portion and the second portion; a first hydraulic passage for fluid communication with the first portion of the chamber to move the piston in a first direction; and a second hydraulic passage for fluid communication with the second portion of the chamber to move the piston in a second direction.

In another embodiment, an isolation valve for use with a tubular string includes a tubular housing for connection with the tubular string; a closure member disposed in the housing and movable between an open position and a closed position; a flow tube longitudinally movable relative to the housing for opening the closure member; a closure member piston for moving the flow tube; a hydraulic chamber formed between the flow tube and the housing and receiving the piston; a first hydraulic passage for fluid communication between a first portion of the chamber and a control line and for moving the piston in a first direction; and a biasing member disposed in a second portion for moving the piston in a second direction.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally relate to an isolation valve. The isolation valve may be a downhole deployment valve. In one or more of the embodiments described herein, a single control line may be used to operate the isolation valve between an open position and a closed position. To better understand aspects of the present disclosure and the methods of use thereof, reference is hereafter made to the accompanying drawings.

Figure 1A:
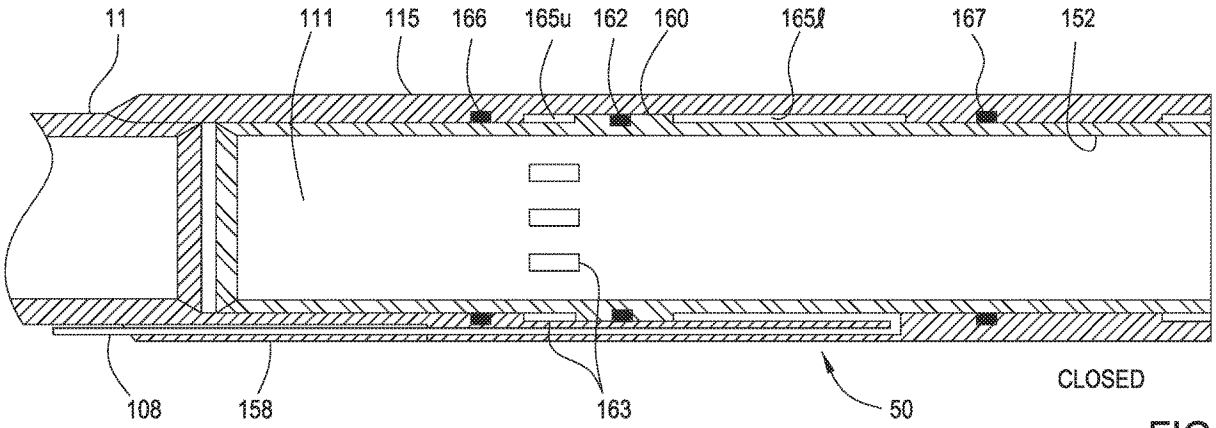
FIGS. 1A and 1B illustrate an exemplary isolation valve in the closed position.
Figure 1B:
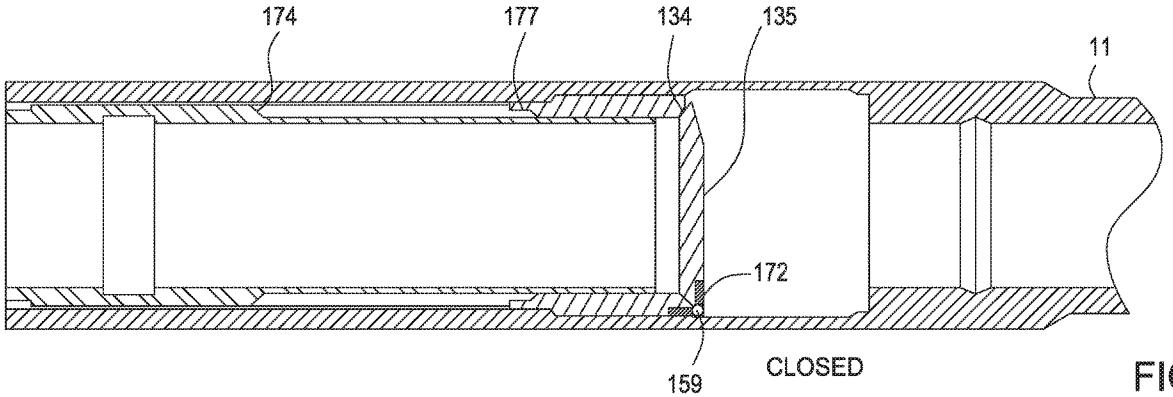

FIGS. 1A and 1B illustrate an exemplary embodiment of an isolation valve 50 in a closed position. The isolation valve 50 includes a tubular housing 115, an opener, such as a flow tube 152, a closure member, such as a flapper 135, and a seat 134. To facilitate manufacturing and assembly, the housing 115 may include one or more sections connected together, such by threaded couplings and/or fasteners. The upper and lower portions of the housing 115 may include threads, such as a pin or box, for connection to other casing sections of a casing string 11. Interfaces between the housing sections and the casing 11 may be isolated, such as by using seals. The isolation valve 50 may have a longitudinal bore 111 therethrough for passage of fluid and the drill string. In this embodiment, the seat 134 may be a separate member connected to the housing 115, such as by threaded couplings and/or fasteners.

Figure 2A:
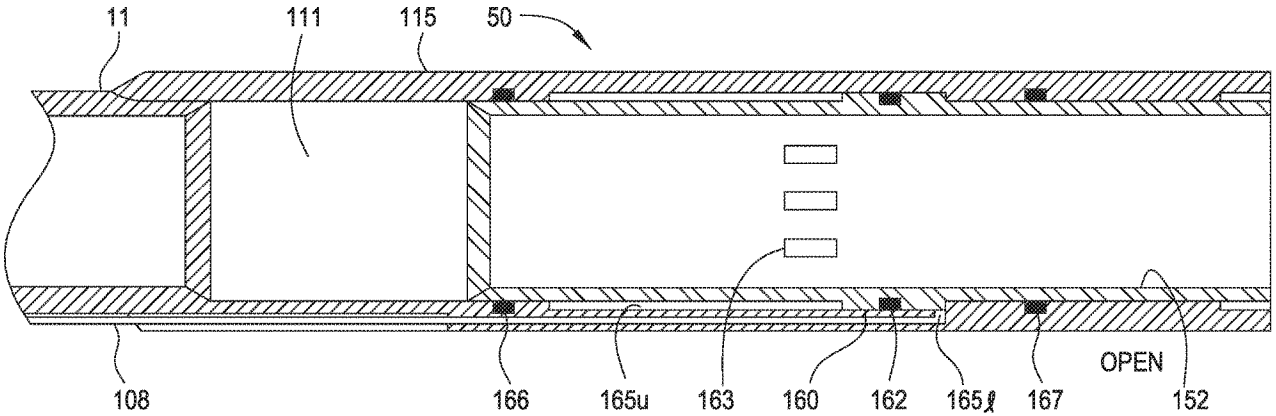
FIGS. 2A and 2B illustrate the isolation valve of FIGS. 1A-1B in the open position.
Figure 2B:
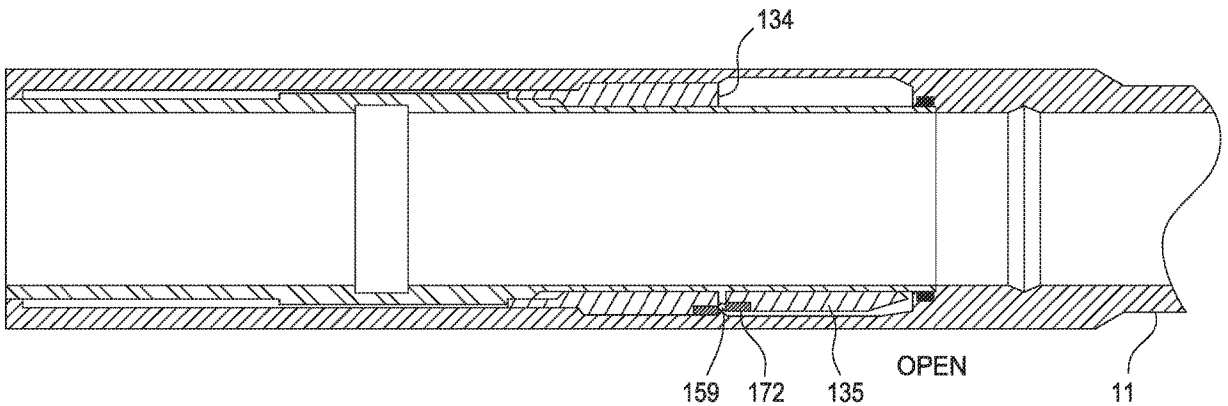

The flow tube 152 may be disposed within the housing 115 and longitudinally movable relative thereto between an upper position (shown FIGS. 1A-1B) and a lower position (shown FIGS. 2A-2B). The flow tube 152 is configured to urge the flapper 135 toward the open position when the flow tube 152 moves to the lower position. The flow tube 152 may have one or more portions connected together. A piston 160 is coupled to the flow tube 152 for moving the flow tube 152 between the lower position and the upper position. The piston 160 may carry a seal 162 for sealing an interface formed between an outer surface thereof and an inner surface of the housing 115.

A fluid chamber 165 may be formed between an inner surface of the housing 115 and an outer surface of the flow tube 152. The fluid chamber 165 may be defined radially between the flow tube 152 and a recess in the housing 115 and longitudinally between an upper shoulder and a lower shoulder in the recess. The housing 115 may carry a guide ring 166 located adjacent to an upper shoulder and a lower seal 167 located adjacent to the lower shoulder. The piston 160 separates the chamber 165 into an upper chamber 165*u* and a lower chamber 165*l*.

The lower chamber 165*l* may be in fluid communication with a hydraulic passage 158 formed through a wall of the housing 115. The hydraulic passage 158 may be connected to a control line 108 that extends to the surface. The upper chamber 165*u* may be in fluid communication with the fluid in the bore 111 of the housing 115. In one example, the flow tube 152 may include one or more ports 163 for fluid communication between the bore 111 and the upper chamber 165*u*. The ports 163 may be any suitable size for communicating a sufficient amount of fluid into the upper chamber 165*u* for activating the piston 160. As shown, eight ports 163 are used. However, any suitable number of ports may be used depending on the size of the ports. For example, ten or more ports may be provided to communicate fluid. In one example, the ports may be sized to filter out debris from entering the upper chamber 165*u*. In another example, a filter may be added to filter out the debris.

Figure 3:
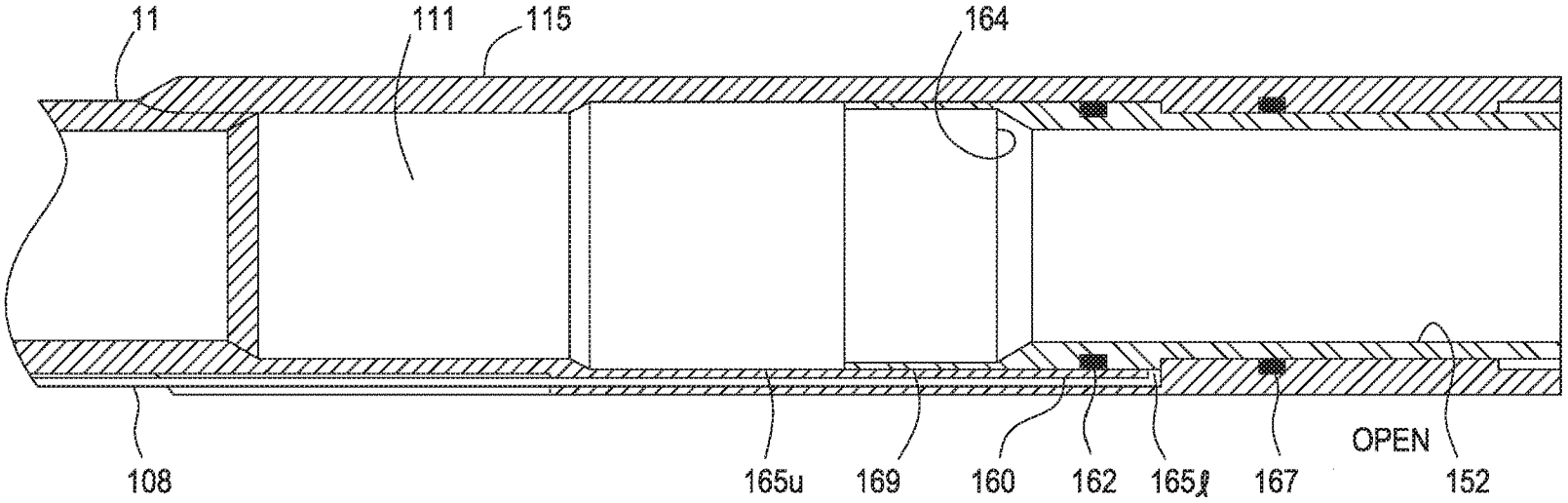
FIG. 3 illustrate a partial view of another embodiment of an isolation valve.

In another embodiment, at least a portion of the flow tube 152 above the piston 160 may be removed such that the piston 160 can communicate with the bore 111, without use of the ports 163. FIG. 3 illustrate a partial view of an embodiment of the flow tube 152 without ports 163. In this respect, the upper piston surface 164 is directly exposed to the fluid in the bore 111. The upper portion of the piston 160 may include an optional protective sleeve 169. As shown, the protective sleeve 169 is disposed around the outer diameter of the piston 160 and protects the sealing surface on the interior of the housing 115 engaged by the piston seal 162 from damage by debris. The protective sleeve 169 may have a length sufficient to protect the entire length of the sealing surface.

In another embodiment, the lower chamber 165*l* is in fluid communication with the fluid in the bore 111, and the upper chamber 165*u* is in fluid communication with the control line 108. In yet another embodiment, instead of the bore 111, the upper chamber 165*u* or the lower chamber 165*l* is in fluid communication with the annulus pressure outside the isolation valve 50, and the other chamber is in fluid communication with the control line 108. In a further embodiment, the upper chamber 165*u* or the lower chamber 165*l* is in fluid communication with the bore 111 and the other chamber is in fluid communication with the annulus pressure. In another embodiment, a biasing member such as a spring may be optionally provided in at least one of the upper and lower chambers 265*u*, 265*l* to facilitate movement of the piston 160

The isolation valve 50 may further include a hinge 159. The flapper 135 may be pivotally coupled to the seat 134 by the hinge 159. The flapper 135 may pivot about the hinge 159 between an open position (shown FIG. 2B) and a closed position. The flapper 135 may be positioned below the seat 134 such that the flapper may open downwardly. An inner periphery of the flapper 135 may engage the seat 134 in the closed position, thereby closing fluid communication through the casing 11. The interface between the flapper 135 and the seat 134 may be a metal to metal seal. The flapper 135 may be biased toward the closed position such as by a flapper spring 172. The main portion may be connected to the seat 134 and the extension may be connected to the flapper 135. In one embodiment, the flow tube 152 may include a locking member 174 for engaging a locking profile 177 of the seat 134. When engaged, the locking member 174 will retain the flow tube 152 in the lower position, thereby keeping the flapper 135 in the open position.

The flapper 135 may be opened and closed by interaction with the flow tube 152. FIGS. 1A-1B show the flapper 135 in the closed position. Downward movement of the flow tube 152 may engage the lower portion thereof with the flapper 135, thereby pushing and pivoting the flapper 135 to the open position against the springs. The flow tube 152 is urged downward when the pressure in the upper chamber 165*u* is greater than the pressure in the lower chamber 165*l*. The pressure differential between the upper chamber 165*u* and the lower chamber 165*l* may be controlled by increasing the pressure in the upper chamber 165*u*, decreasing the pressure in the lower chamber 165*l*, or combinations thereof. For example, the pressure in the upper chamber 165*u* can be increased by increasing the pressure in the bore 111 of the casing 11. The pressure in the bore 111 may include the hydrostatic pressure, the applied pressure, or combinations thereof. In another example, the pressure in the control line 108 may be reduced sufficiently such that the pressure in the lower chamber 165*l* is less than the pressure in the upper chamber 165*u*. The pressure in the control line 108 may include the hydrostatic pressure, the applied pressure, or combinations thereof. In another embodiment, depending on the size of the piston 160, the flow tube 152 is urged downward when the pressure in the upper chamber 165*u* is less than the pressure in the lower chamber 165*l*. For example, depending on the size of the piston 160, the pressure in the control line can be adjusted to above, equal, or below the pressure in the casing string to open the flapper 235.

FIGS. 2A-2B show the flapper 135 in the open position. As shown, the flow tube 152 has extended past and pivoted the flapper 135 to the open position. The flow tube 152 may sealingly engage an inner surface of the housing 115 below the flapper 135. Also, the piston 160 has moved downward relative to the housing 115, thereby decreasing the size of the lower chamber 165*l*.

To close the flapper 135, the flow tube 152 is moved upward to cause its lower portion to disengage from the flapper 135, thereby allowing the flapper 135 to pivot to the closed position. In one embodiment, the flapper 135 is pivoted to the closed position by the spring 172. The flow tube 152 is urged upward when the pressure in the lower chamber 165*l* is greater than the pressure in the upper chamber 165*u*. The pressure differential between the upper chamber 165*u* and the lower chamber 165*l* may be controlled by decreasing the pressure in the upper chamber 165*u*, increasing the pressure in the lower chamber 165*l*, or combinations thereof. For example, the pressure in the upper chamber 165*u* can be decreased by decreasing the pressure in the bore 111 of the casing 11. In another example, the pressure in the control line 108 may be increased sufficiently such that the pressure in the lower chamber 165*l* is greater than the pressure in the upper chamber 165*u*. As shown in FIGS. 1A-1B, the flow tube 152 has retracted to a position above the flapper 135. Also, the piston 160 has moved upward to reduce the size of the upper chamber 165*u*.

In yet another embodiment, the control line 108 may be supplied with a fluid that will create a hydrostatic pressure in the lower chamber 165*l* that is less than the pressure in the upper chamber 165*u*. In this respect, the valve 50 is held in the open position by the pressure in the upper chamber 165*u*, which can be the hydrostatic pressure, applied pressure, or combinations thereof. In one example, the fluid in the control line can be a gas such as nitrogen, a liquid, or combinations thereof.

To close the valve 50, pressure in the control line 108 is increased to create a higher pressure in the lower chamber 165*l* (i.e., the closed side) than the pressure in the upper chamber 165*u* (i.e., open side). Depending on the density of the fluid supplied, the volume of fluid necessary to increase the pressure in the control line 108 may be different. For example, more compressible fluid may require a larger volume of fluid to achieve the same pressure increase as a less compressible fluid. The volume of fluid supplied may be monitored to ensure the pressure is sufficient to close the valve 50.

To re-open the valve 50, pressure is released from the control line 108 at surface such that the pressure on the closed side of the piston 160 (i.e., lower chamber 165*l*) returns to a value less than the pressure on the open side (i.e., upper chamber 165*u*) of the piston 160. As a result, the valve 50 opens. The volume of fluid released may be monitored to ensure the pressure was sufficient to close the valve 50.

In another embodiment, the piston 160 may be moved downward sufficiently such that the locking member 174 engages the locking profile 177 of the seat 134. In this respect, the flow tube 152 can be retained in the lower portion, thereby keeping the flapper 135 in the open position so other downhole operations may be performed.

In yet another embodiment, the isolation valve 50 may be operated between the open and closed positions during run-in. For example, the pressure may supplied to the lower chamber 265*l* to move or retain the piston 260 in the upper position, thereby allowing the flapper 135 to move to or remain in the closed position.

Figure 4A:
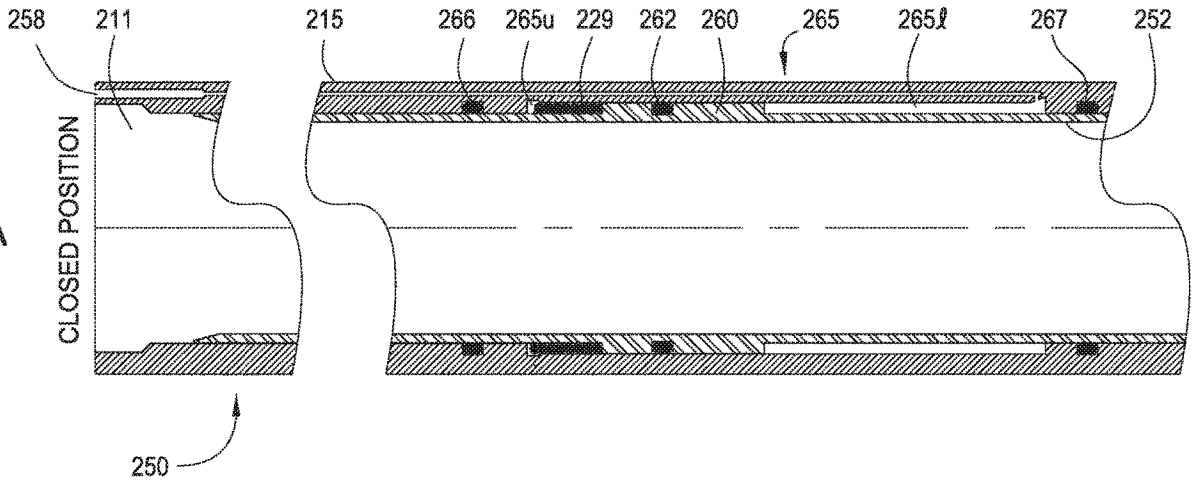
FIGS. 4A and 4B illustrate an exemplary isolation valve in the closed position.
Figure 4B:
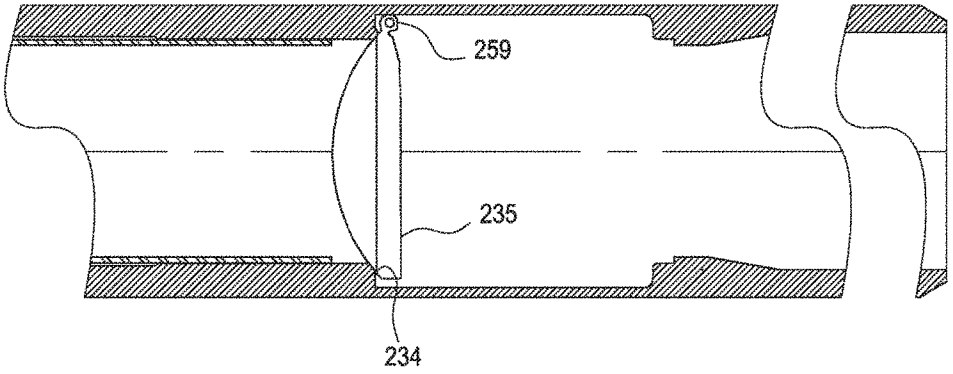

FIGS. 4A and 4B illustrate another exemplary embodiment of an isolation valve 250 in a closed position. The isolation valve 250 includes a tubular housing 215, an opener, such as a flow tube 252, a closure member, such as a flapper 235, and a seat 234. To facilitate manufacturing and assembly, the housing 215 may include one or more sections connected together, such by threaded couplings and/or fasteners. The upper and lower portions of the housing 215 may include threads, such as a pin or box, for connection to other casing sections of a casing string 11. Interfaces between the housing sections and the casing 11 may be isolated, such as by using seals. The isolation valve 250 may have a longitudinal bore 211 therethrough for passage of fluid and the drill string.

Figure 5A:
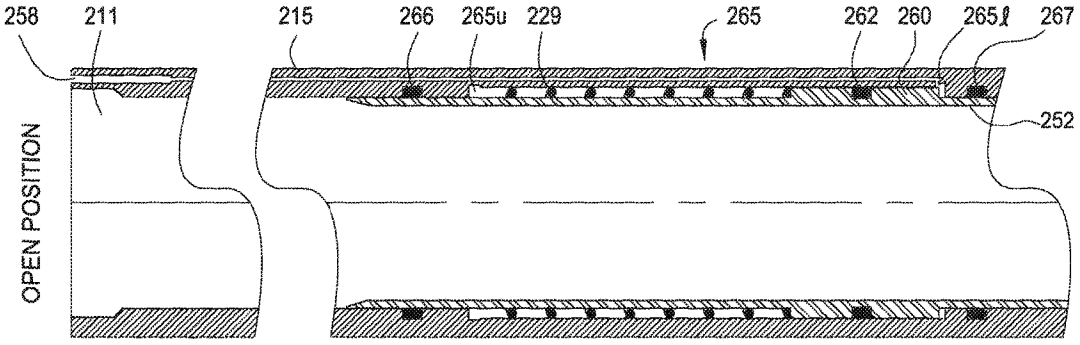
FIGS. 5A and 5B illustrate the isolation valve of FIGS. 4A-4B in the open position.
Figure 5B:
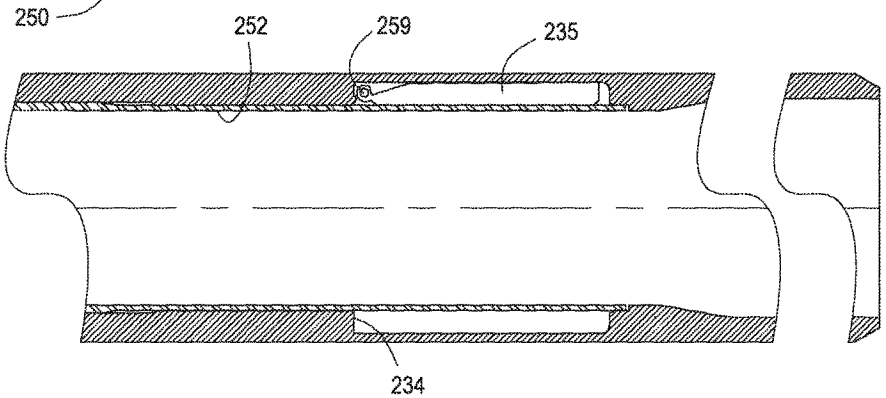

The flow tube 252 may be disposed within the housing 215 and longitudinally movable relative thereto between an upper position (shown FIGS. 4A-4B) and a lower position (shown FIGS. 5A-5B). The flow tube 252 is configured to urge the flapper 235 toward the open position when the flow tube 252 moves to the lower position. The flow tube 252 may have one or more portions connected together. A piston 260 is coupled to the flow tube 252 for moving the flow tube 252 between the lower position and the upper position. The piston 260 may carry a seal 262 for sealing an interface formed between an outer surface thereof and an inner surface of the housing 215.

A hydraulic chamber 265 may be formed between an inner surface of the housing 215 and an outer surface of the flow tube 252. The hydraulic chamber 265 may be defined radially between the flow tube 252 and a recess in the housing 215 and longitudinally between an upper shoulder and a lower shoulder in the recess. The housing 215 may carry an upper seal 266 located adjacent an upper shoulder and a lower seal 267 located adjacent to the lower shoulder. The piston 260 separates the chamber 265 into an upper chamber 265*u* and a lower chamber 265*l*.

The lower chamber 265*l* may be in fluid communication with a hydraulic passage 258 formed through a wall of the housing 215. The hydraulic passage 258 may be connected to a control line that extends to the surface. The pressure in the upper chamber 265*u* may be preset at a suitable pressure such as atmospheric pressure. A biasing member, such as a spring 229, is disposed in the upper chamber 265*u* and is configured to urge the flow tube 252 to the lower position.

The flapper 235 may be pivotally coupled to the seat 234 using a hinge 259. The flapper 235 may pivot about the hinge 259 between an open position, as shown in FIG. 5B, and a closed position, as shown in FIG. 4B. The flapper 235 may be positioned below the seat 234 such that the flapper may open downwardly. An inner periphery of the flapper 235 may engage the seat 234 in the closed position, thereby closing fluid communication through the casing 11. The interface between the flapper 235 and the seat 234 may be a metal to metal seal. The flapper 235 may be biased toward the closed position such as by a flapper spring. In one embodiment, the flow tube 252 may include a locking member for engaging a locking profile of the seat 234 to the flow tube 252 in the lower position, thereby keeping the flapper 235 in the open position.

The flapper 235 may be opened and closed by interaction with the flow tube 252. FIGS. 4A-4B show the flapper 235 in the closed position. In the closed position, the pressure in the lower chamber 265*l* is sufficient to overcome the biasing force of the spring 229 and the pressure in the upper chamber 265*u*. The pressure in the lower chamber 265*l* is controlled by the control line.

Downward movement of the flow tube 252 may push and pivot the flapper 235 to the open position against the flapper spring. The flow tube 252 is urged downward when the pressure in the upper chamber 265*u* and the force of the spring 229 are greater than the pressure in the lower chamber 265*l*. In one example, the pressure in the lower chamber 265*l* is decreased to allow the spring 229 to urge the flow tube 252 downward.

FIGS. 5A-5B show the flapper 235 in the open position. As shown, the flow tube 252 has extended past and pivoted the flapper 235 to the open position. The flow tube 252 may sealingly engage an inner surface of the housing 215 below the flapper 235. Also, the spring 229 is in an expanded state. Further, the piston 260 has moved downward relative to the housing 215, thereby decreasing the size of the lower chamber 265*l*.

To close the flapper 235, the flow tube 252 is moved upward to disengage from the flapper 235, thereby allowing the flapper 235 to pivot to the closed position. In one embodiment, the flapper 235 is pivoted to the closed position by the flapper spring. The flow tube 252 is urged upward when the pressure in the lower chamber 265*l* is greater than the combination of the force of the spring 229 and the pressure in the upper chamber 265*u*. In one example, the pressure in the control line may be increased sufficiently such that the pressure in the lower chamber 265*l* is greater than the biasing force of the spring 229 and the pressure in the upper chamber 265*u*. As shown in FIGS. 4A-4B, the flow tube 252 has retracted to a position above the flapper 235. Also, the piston 260 has moved upward to reduce the size of the upper chamber 265*u* and compressed the spring 229.

Figure 6A:
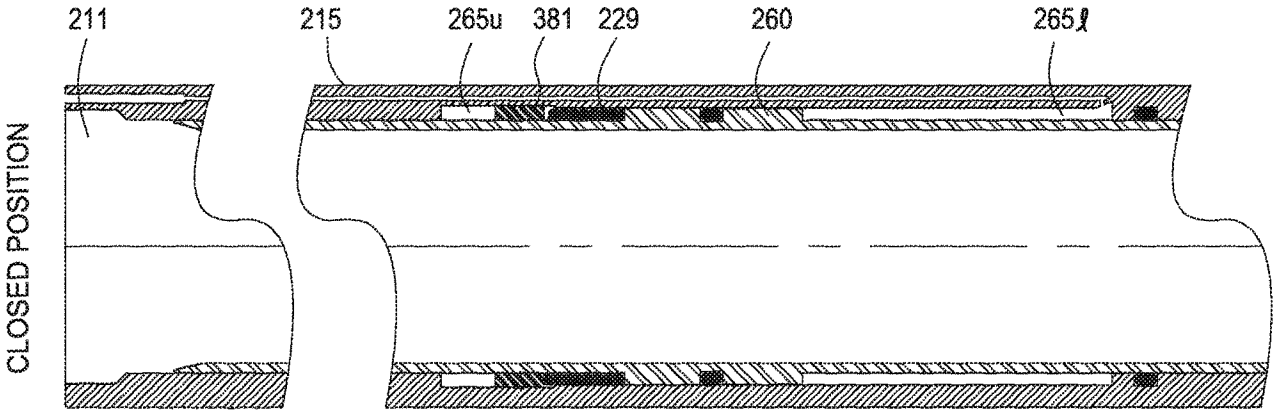
FIGS. 6A and 6B illustrate an exemplary isolation valve in the closed position.
Figure 6B:
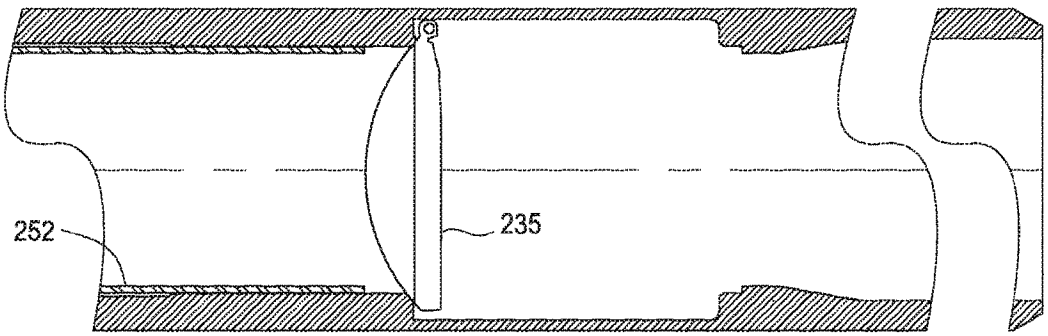
Figure 7A:
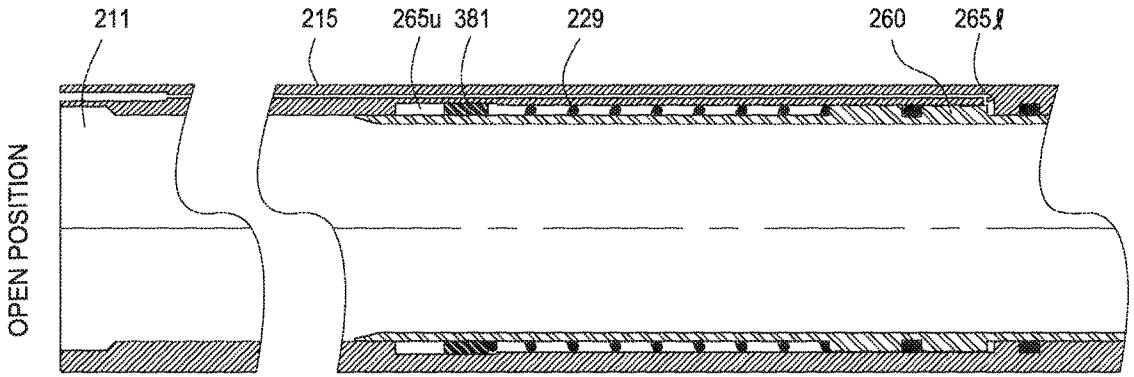
FIGS. 7A and 7B illustrate the isolation valve of FIGS. 6A-6B in the open position.
Figure 7B:
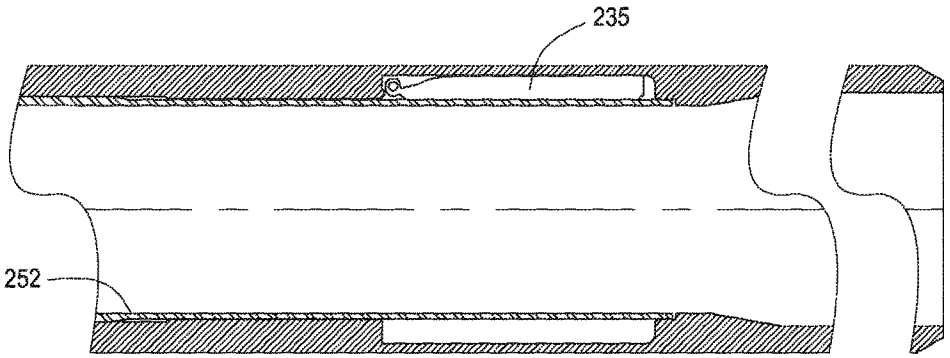

FIGS. 6A-6B illustrate another embodiment of an isolation valve 350 in a closed position. FIGS. 7A-7B show the valve 350 in an open position. For sake of clarity, features of this valve 350 that are similar to features in FIGS. 4A-4B will not be described in detail. One of the differences between this valve 350 and the valve 250 in FIGS. 4A-4B is the presence of a floating piston 381. The floating piston 381 is disposed in the upper chamber 265*u* between the spring 229 and the upper shoulder of the recess. The floating piston 381 may include a sealing member for sealing engagement with the upper chamber 265*u*. For example, a first seal ring may be disposed on an inner surface of the floating piston 381 for engaging the flow tube 252, and a second seal ring may be disposed on an outer surface of the floating piston 381 for engaging the housing 215. In this arrangement, the upper surface of the floating piston 381 is exposed to the hydrostatic pressure in the bore 211 and the lower surface is in contact with the spring 229. The piston 381 may float in the upper chamber 365*u* in response to the hydrostatic pressure in the bore 211. In this respect, the pressure in the lower chamber 2651 need to only overcome the biasing force of the spring 229 to move the flow tube 252.

FIGS. 6A-6B show the flapper 235 in the closed position. The flapper 235 may be opened and closed by interaction with the flow tube 252. In the closed position, the pressure in the lower chamber 265*l* acting on the flow tube piston 260 is sufficient to overcome the biasing force of the spring 229. The floating piston 381 is floating in the upper chamber 265*u* due to the hydrostatic pressure in the bore 211. The spring 229 is compressed between the floating piston 381 and the flow tube piston 260. The flow tube 252 has moved up sufficiently to allow the flapper 235 to close.

Downward movement of the flow tube 252 may push and pivot the flapper 235 to the open position against the flapper spring. The flow tube 252 is urged downward when the force of the spring 229 is greater than the pressure in the lower chamber 265*l*. In one example, the pressure in the lower chamber 265*l* is decreased to allow the spring 229 to urge the flow tube 252 downward.

FIGS. 7A-7B show the flapper 235 in the open position. As shown, the flow tube 252 has extended past and pivoted the flapper 235 to the open position. The flow tube 252 may sealingly engage an inner surface of the housing 215 below the flapper 235. Also, the spring 229 is in an expanded state. The piston 260 has moved downward relative to the housing 215, thereby decreasing the size of the lower chamber 265*l*. Further, the floating piston 381 has remained substantially in the same position as shown in FIGS. 6A-6B because the hydrostatic pressure has not changed sufficiently to move the floating piston 381.

To close the flapper 235, the flow tube 252 is moved upward to disengage from the flapper 235, thereby allowing the flapper 235 to pivot to the closed position. In one embodiment, the flapper 235 is pivoted to the closed position by the spring. Because upper end of the spring 229 is acting against the floating piston 381, the flow tube 252 is urged upward when the pressure in the lower chamber 265*l* is greater than the force of the spring 229. The pressure in the lower chamber 265*l* may be increased by supplying increased pressure via the control line. As shown in FIGS. 6A-6B, the flow tube 252 has retracted to a position above the flapper 235. Also, the flow tube piston 260 has moved upward to reduce the size of the upper chamber 265*u* and compressed the spring 229 against the floating piston 381.

Figures 8A, 8B, 8C:
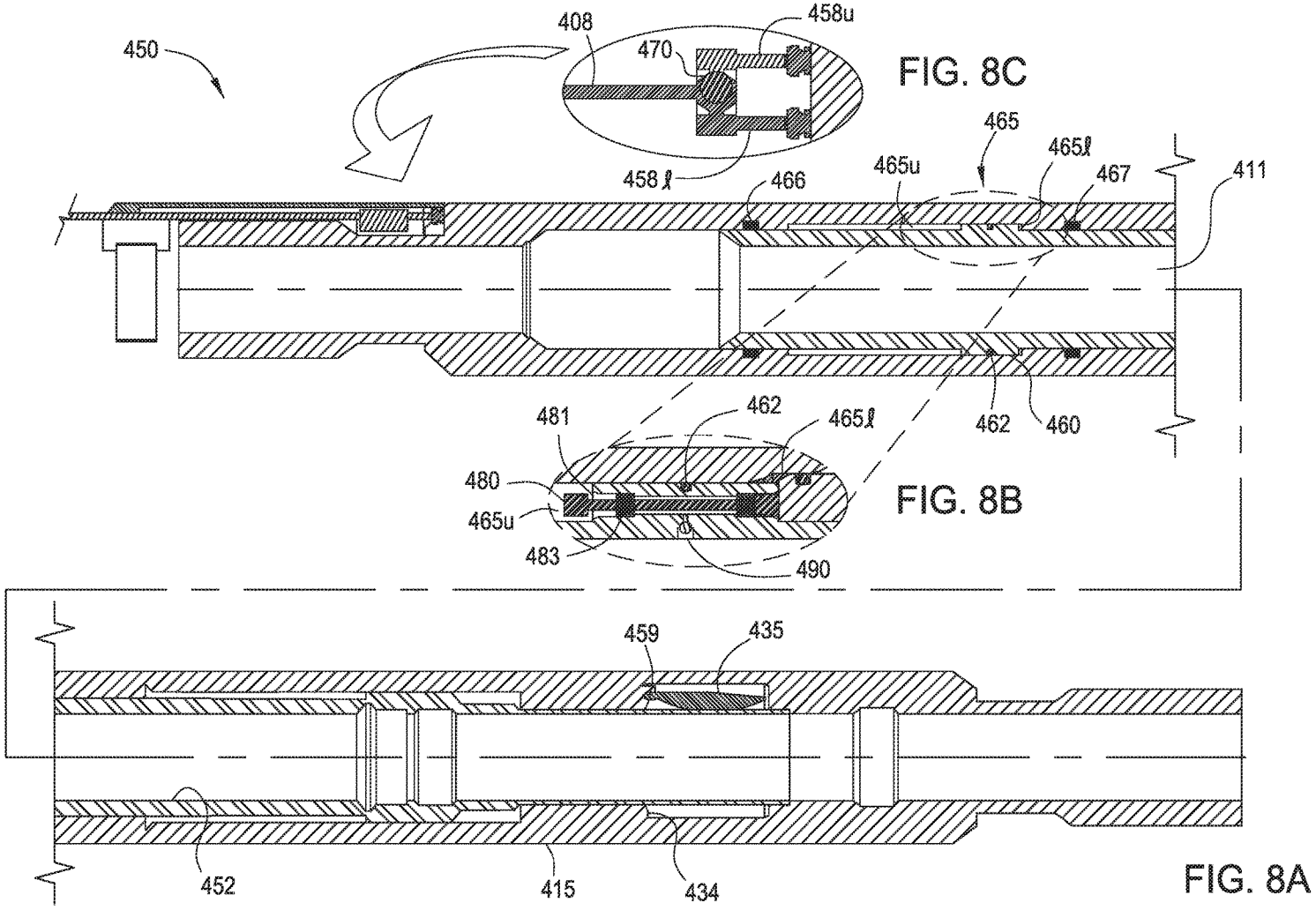
FIGS. 8A-8C illustrate an exemplary isolation valve in the open position.

FIGS. 8A-8C illustrate an exemplary embodiment of an isolation valve 450 in an open position. The isolation valve 450 includes a tubular housing 415, an opener, such as a flow tube 452, a closure member, such as a flapper 435, and a seat 434. To facilitate manufacturing and assembly, the housing 415 may include one or more sections connected together, such by threaded couplings and/or fasteners. The upper and lower portions of the housing 415 may include threads, such as a pin or box, for connection to other casing sections of a casing string 11. Interfaces between the housing sections and the casing 11 may be isolated, such as by using seals. The isolation valve 450 may have a longitudinal bore 411 therethrough for passage of fluid and the drill string. In this embodiment, the seat 434 may be a separate member connected to the housing 415, such as by threaded couplings and/or fasteners.

Figures 10A, 10B:
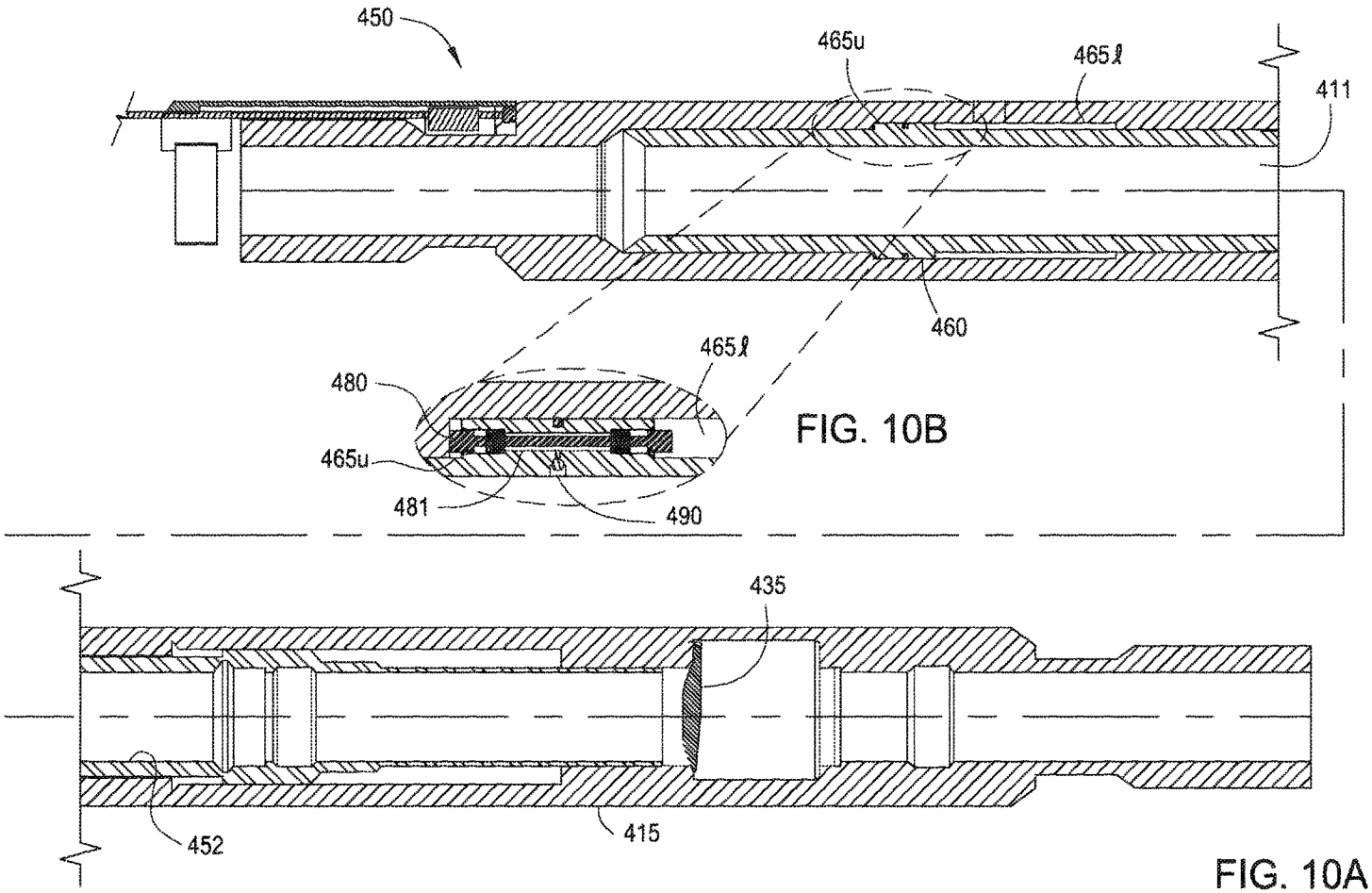
FIGS. 10A and 10B illustrate the isolation valve of FIG. 8A in the closed position.

The flow tube 452 may be disposed within the housing 415 and longitudinally movable relative thereto between a lower position (shown FIG. 8A) and an upper position (shown FIG. 10A). The flow tube 452 is configured to urge the flapper 435 toward the open position when the flow tube 452 moves to the lower position. The flow tube 452 may have one or more portions connected together. A piston 460 is coupled to the flow tube 452 for moving the flow tube 452 between the lower position and the upper position. FIG. 8B is an enlarged, partial view of the piston 460. The piston 460 may carry a seal 462 for sealing an interface formed between an outer surface thereof and an inner surface of the housing 415.

A hydraulic chamber 465 may be formed between an inner surface of the housing 415 and an outer surface of the flow tube 452. The hydraulic chamber 465 may be defined radially between the flow tube 452 and a recess in the housing 415 and longitudinally between an upper shoulder and a lower shoulder in the recess. The housing 415 may carry an upper seal 466 located adjacent to an upper shoulder and a lower seal 467 located adjacent to the lower shoulder. The piston 460 separates the chamber 465 into an upper chamber 465*u* and a lower chamber 465*l*.

The lower chamber 465*l* is in fluid communication with a lower hydraulic passage 458*l*, and the upper chamber 465*u* is in fluid communication with an upper hydraulic passage 458*u*. The passages 458*u*, 458*l* may be formed through a wall of the housing 415. The hydraulic passages 458*u*, 458*l* may be connected to a control line 408 that extends to the surface.

A control valve 470 is used to control fluid communication between the control line 408 and the upper and lower hydraulic passages 458*u*, 458*l*. FIG. 8C is an enlarged, partial view of the control valve 470 and the hydraulic passages 458*u*, 458*l*. In one embodiment, the control valve 470 is a ball valve that can move between closing off the upper passage 458*u* and closing off the lower passage 458*l*. Other exemplary control valves include a shuttle valve, poppet valve, and valve having a spring switch.

The piston 460 may include a piston bore 481 for receiving a rod 480. The piston bore 481 provides fluid communication between the upper chamber 465*u* and the lower chamber 465*l*. The rod 480 is longer than the piston bore 481 and is longitudinally movable relative to the bore 481. The rod 480 includes a rod body and a head at each end that is sealingly engageable with the piston bore 481. The rod body has a diameter that is smaller than the piston bore 481. The length of the rod 480 is configured such that when the head at one end is sealingly engaged with the piston bore 481, the head at the other end of the piston bore 481 allows fluid communication between the piston bore 481 and the chamber 465. In one embodiment, one or more seals are disposed around the perimeter of the heads of the rod 480. Referring to FIG. 8B, the lower head of the rod 480 is sealingly engaged with the lower end of the piston bore 481, there by closing fluid communication between the piston bore 481 and the lower chamber 465*l*. Because of the longer length of the rod 480, the upper head of the rod 480 is not engaged with the upper end of the piston bore 481, thereby allowing fluid communication between the piston bore 481 and the upper chamber 465*u*. One or more optional centralizers 483 may be used to support the rod body in the bore 481. In another embodiment, the rod body may include grooves on its outer surface to provide fluid communication between the chambers and the one way valve. In this respect, the rod body may optionally have a diameter that is about the same size as the piston bore. In yet another embodiment, the rod may include seals at each end for sealing engagement with the piston bore 481.

A one way valve such as a check valve 490 or a pressure relief valve may be used to provide selective fluid communication between the piston bore 481 and the valve bore 411. In one embodiment, the check valve 490 is located in the piston 460 and configured to release fluid from the piston bore 481 into the bore 411 when a predetermined pressure differential is reached between the piston bore 481 and the valve bore 411.

The isolation valve 450 may further include a hinge 459. The flapper 435 may be pivotally coupled to the seat 434 by the hinge 459. The flapper 435 may pivot about the hinge 459 between an open position (shown FIG. 8A) and a closed position (shown in FIG. 10A). The flapper 435 may be positioned below the seat 434 such that the flapper 435 may open downwardly. An inner periphery of the flapper 435 may engage the seat 434 in the closed position, thereby closing fluid communication through the casing 11. The interface between the flapper 435 and the seat 434 may be a metal to metal seal. The flapper 435 may be biased toward the closed position such as by a flapper spring.

The flapper 435 may be opened and closed by interaction with the flow tube 452. FIG. 8A show the flapper 435 in the open position. As shown, the flow tube 452 has extended past and pivoted the flapper 435 to the open position. The flow tube 452 may sealingly engage an inner surface of the housing 415 below the flapper 435. Also, the piston 460 has moved downward relative to the housing 415, thereby decreasing the size of the lower chamber 465*l*. FIG. 8B shows the lower head of the rod 480 sealingly engaged with the piston bore 481 and abutted against the lower shoulder of the chamber 465. The upper head is not engaged with the piston bore 481 and the piston bore 481 is in fluid communication with the upper chamber 465*u*. FIG. 8C shows the control valve 470 in the neutral position.

To close the flapper 435, fluid from surface is pumped through the control line 408 to the control valve, which in this example is a ball valve 470. Because the upper chamber 465*u* is open to the piston bore 481, fluid flow through the upper passage 458*u* and into the upper chamber 465*u* can flow through the check valve 490. Fluid flow through the ball valve 470 moves the ball to seat and close off the upper hydraulic passage 458*u* and allow pressure to build in the lower hydraulic passage 458*l*. Pressurized fluid directed to the lower chamber 465*l* via the lower hydraulic passage 458*l* acts on the piston 460 to urge the flow tube 452 upward, thereby allowing the flapper 435 to close. The pressure in the lower chamber 465*l* maintains the rod 480 in sealing engagement as the piston 460 moves upward.

Figures 9A, 9B:
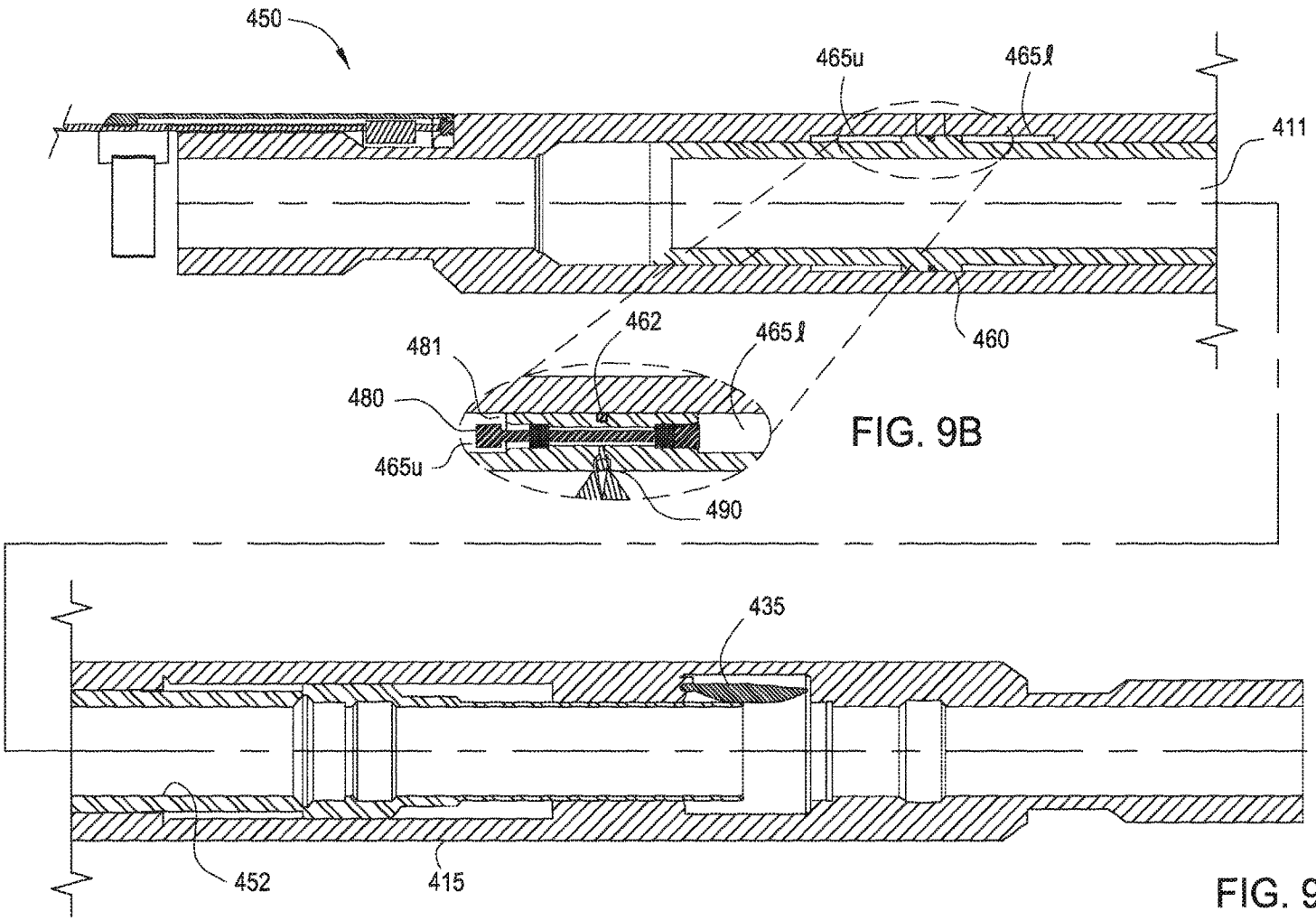
FIGS. 9A and 9B illustrate the isolation valve of FIG. 8A moving to the closed position.

Pressure in the upper chamber 465*u* increases as the piston 460 moves upward. At a predetermined pressure differential, the check valve 490 opens to allow fluid in the upper chamber 465*u* to flow into the valve bore 411. FIG. 9A shows the piston 460 moved up partially in the chamber 465 and the flow tube 452 moved up partially relative to the flapper 435, which is still open.

As the piston 460 completes its travel in the chamber 465, the rod 480 makes contact with the upper shoulder of the chamber 465. The piston 460 then moves relative to the rod 480 to push the rod 480 into the piston bore 481 to seal off both ends of the piston bore 481, as shown FIG. 10B. In this position, the fluid is prevented from exiting the check valve 490.

Further movement of the piston 460 moves the lower head of the rod 480 out of sealing engagement with the piston bore 481. Pressurized fluid in the lower chamber 465*l* is now allowed to exit through the check valve 490 and into the valve bore 411. The drop in pressure causes the ball in the ball valve 470 to move to a neutral position, as shown in FIG. 8C. FIG. 10A shows the flow tube 452 in the upper position and the flapper 435 in the closed position.

This process can be repeated in the opposite direction to close the isolation valve 450.

If fluid continues to be pumped, then the pressure will now build on the upper hydraulic passage 458*u* and leak from the lower chamber 465*l* through the check valve 490. The ball of the ball valve 470 will shift to close off the lower hydraulic passage 458*l*. Pressurized fluid directed to the upper chamber 465*u* via the upper hydraulic passage 458*u* acts on the piston 460 to urge the flow tube 452 downward, thereby opening the flapper 435. The pressure in the upper chamber 465*u* maintains the rod 480 in sealing engagement as the piston 460 moves downward.

As the piston 460 moves downward, fluid in the lower chamber 465*l* exits into the valve bore 411 via the check valve 490. As the piston 460 completes its downward travel in the chamber 465, the lower head of the rod 480 makes contact with the lower shoulder of the chamber 465. The piston 460 then moves relative to the rod 480 to push the rod 480 into the piston bore 481 to seal off both ends of the piston bore 481.

Further movement of the piston 460 moves the upper head of the rod 480 out of sealing engagement with the piston bore 481. Pressurized fluid is now allowed to exit through the check valve 490 and into the valve bore 411. The drop in pressure causes the ball in the ball valve 470 to move to a neutral position, as shown in FIG. 8C.

In one embodiment, the isolation valve 450 cycle may be controlled by the volume of fluid pumped from surface. For example, an operator may keep track of volume of fluid pumped to determine the location of the piston 460. In another embodiment, a drop in pressure will also indicate the position of the piston. For example, when the piston 460 has reached the lower shoulder of the chamber 465, the upper chamber 465*u* will begin fluid communication with the check valve 490. Fluid relieved through the check valve 490 will cause a pressure drop in the upper chamber 465*u* to indicate the piston has reached the lower end of the chamber 465.

In any of the embodiments described herein, the control line may extend from the surface, through the wellhead, along an outer surface of the casing string, and to the isolation valve. The control line may be fastened to the casing string at regular intervals. Hydraulic fluid may be disposed in the upper and lower chambers. The hydraulic fluid may be an incompressible liquid, such as a water based mixture with glycol, a refined oil, a synthetic oil, or combinations thereof; a compressible fluid such an inert gas, e.g., nitrogen; or a mixture of compressible and incompressible fluids. In yet another embodiment, a plurality of isolation valves may be attached to the tubular string. Each of the isolation valves may be operated using the same or different hydraulic mechanisms described herein. For example, plurality of isolation valves may be attached in series and each of the valves may be exposed to the bore pressure on one side and attached to a different control line.

In one embodiment, an isolation valve for use with a tubular string includes a tubular housing for connection with the tubular string; a closure member disposed in the housing and movable between an open position and a closed position; a flow tube longitudinally movable relative to the housing for opening the closure member; a piston for moving the flow tube; a fluid chamber formed between the flow tube and the housing and receiving the piston; a first fluid passage for fluid communication between a first portion of the chamber and a control line and for moving the piston in a first direction; and a second fluid passage for fluid communication between a second portion of the chamber and a bore of the tubular string and for moving the piston in a second direction.

In another embodiment, a method of operating an isolation valve includes deploying a casing string equipped with an isolation valve, wherein the isolation valve includes a piston for moving a flow tube to open or close the closure member; fluidly communicating a first side of the piston with a pressure in a control line; fluidly communicating a second side of the piston with a pressure in the casing string; and moving the flow tube to open the closure member.

In one or more of the embodiments described herein, movement of the piston in the first direction allows the closure member to move to the closed position.

In one or more of the embodiments described herein, movement of the piston in the second direction moves the closure member to the open position.

In one or more of the embodiments described herein, a hydrostatic pressure in the second portion of the chamber is greater than a pressure in the first portion of the chamber.

In one or more of the embodiments described herein, the second fluid passage includes a port formed through a wall of the flow tube.

In one or more of the embodiments described herein, the port is sufficiently sized to filter out debris.

In one or more of the embodiments described herein, a plurality of ports is provided in the wall of the flow tube for communicating fluid to actuate the flow tube.

In one or more of the embodiments described herein, the second fluid passage includes an upper end of the flow tube.

In one or more of the embodiments described herein, a protective sleeve is coupled to the upper end of the flow tube.

In one or more of the embodiments described herein, a biasing member is used to move the piston toward the first direction or the second direction.

In one or more of the embodiments described herein, the method includes increasing the pressure in the control line to a level above the pressure in the casing string to close the closure member.

In one or more of the embodiments described herein, the method includes decreasing the pressure in the control line to a level above the pressure in the casing string to close the closure member.

In one or more of the embodiments described herein, the method includes maintaining a hydrostatic pressure in the control line at a level below the pressure in the casing string.

In one or more of the embodiments described herein, to open the closure member, the pressure in the control line is adjusted to above, equal, or below the pressure in the casing string.

In another embodiment, an isolation valve for use with a tubular string includes a tubular housing for connection with the tubular string; a closure member disposed in the housing and movable between an open position and a closed position; a flow tube longitudinally movable relative to the housing for opening the closure member; a fluid chamber formed between the flow tube and the housing; a piston for moving the flow tube, wherein the piston separates the chamber into a first portion and a second portion; a piston bore for selective fluid communication between the first portion and the second portion; a first fluid passage for fluid communication with the first portion of the chamber to move the piston in a first direction; and a second fluid passage for fluid communication with the second portion of the chamber to move the piston in a second direction.

In one or more of the embodiments described herein, a control valve is provided for controlling fluid communication through the first passage and the second passage.

In one or more of the embodiments described herein, the control valve controls fluid communication of the first passage and the second passage with a control line.

In one or more of the embodiments described herein, a one way valve is in fluid communication with the piston bore.

In one or more of the embodiments described herein, a rod is disposed in the piston bore and configured to selectively block fluid communication between the piston bore and the first portion and the second portion.

In one or more of the embodiments described herein, the rod is longer than the piston bore.

In one or more of the embodiments described herein, the rod includes a seal at each end configured to sealingly engage the piston bore.

In another embodiment, an isolation valve for use with a tubular string includes a tubular housing for connection with the tubular string; a closure member disposed in the housing and movable between an open position and a closed position; a flow tube longitudinally movable relative to the housing for opening the closure member; a closure member piston for moving the flow tube; a fluid chamber formed between the flow tube and the housing and receiving the piston; a first fluid passage for fluid communication between a first portion of the chamber and a control line and for moving the piston in a first direction; and a biasing member disposed in a second portion for moving the piston in a second direction.

In one or more of the embodiments described herein, a floating piston is disposed in the second portion of the chamber for moving the piston of the flow tube, and the biasing member is disposed between the floating piston and the piston of the flow tube.

In one or more of the embodiments described herein, one side of the floating piston is coupled to the biasing member and an opposite side of the floating piston is exposed to a hydrostatic pressure.

In one or more of the embodiments described herein, the fluid may a hydraulic fluid.

While the foregoing is directed to embodiments of the present disclosure, other and further embodiments of the disclosure may be devised without departing from the basic scope thereof, and the scope of the present invention is determined by the claims that follow.

The invention claimed is:

1. An isolation valve for use with a tubular string, comprising:

a tubular housing for connection with the tubular string;

a closure member disposed in the housing and pivotally coupled to a seat having a locking profile, wherein the closure member is movable between an open position and a closed position;

a flow tube having a locking member, wherein the flow tube is longitudinally movable relative to the housing for opening the closure member;

a piston for moving the flow tube;

a fluid chamber formed between the flow tube and the housing and receiving the piston;

a first fluid passage for fluid communication between a first portion of the chamber and a control line and for moving the piston in a first direction; and a second fluid passage for fluid communication between a second portion of the chamber and a bore of the tubular string and for moving the piston in a second direction; and wherein engagement of the locking member with the locking profile retains the closure member in the open position.

2. The isolation valve of claim 1, wherein movement of the piston in the first direction allows the closure member to move to the closed position.

3. The isolation valve of claim 1, wherein movement of the piston in the second direction moves the closure member to the open position.

4. The isolation valve of claim 1, wherein the second fluid passage comprises a port formed through a wall of the flow tube.

5. The isolation valve of claim 1, further comprising a biasing member used to move the piston toward the first direction or the second direction.

6. A method of operating an isolation valve, comprising:

deploying a casing string equipped with an isolation valve, wherein the isolation valve includes a flow tube piston, a floating piston, and a biasing member between the flow tube piston and the floating piston, and a flow tube to open or close the closure member;

fluidly communicating a pressure in a control line to a first portion of a chamber defined between the flow tube and the casing string to act on a first side of the flow tube piston;

fluidly communicating a pressure in the casing string to a second portion of the chamber to act on a first side of the floating piston; and moving the flow tube to open the closure member.

7. The method of claim 6, further comprising increasing pressure in the control line to a level above a biasing force of the biasing member to close the closure member.

8. The method of claim 6, further comprising decreasing the pressure in the control line to a level below a biasing force in the biasing member to open the closure member.

9. The method of claim 6, wherein a second side of the floating piston is coupled to the biasing member.

10. An isolation valve for use with a tubular string, comprising:

a tubular housing for connection with the tubular string;

a closure member disposed in the housing and movable between an open position and a closed position;

a flow tube longitudinally movable relative to the housing for opening the closure member;

a fluid chamber formed between the flow tube and the housing;

a piston for moving the flow tube, wherein the piston separates the chamber into a first portion and a second portion;

a piston bore for selective fluid communication between the first portion and the second portion;

a first fluid passage for fluid communication with the first portion of the chamber to move the piston in a first direction; and a second fluid passage for fluid communication with the second portion of the chamber to move the piston in a second direction.

11. The isolation valve of claim 10, further comprising a control valve for controlling fluid communication through the first passage and the second passage.

12. The isolation valve of claim 11, wherein the control valve controls fluid communication of the first passage and the second passage with a control line.

13. The isolation valve of claim 10, further comprising a one way valve in fluid communication with the piston bore.

14. The isolation valve of claim 10, further comprising a rod disposed in the piston bore and configured to selectively block fluid communication between the piston bore and the first portion and the second portion.

15. The isolation valve of claim 14, wherein the rod is longer than the piston bore.

16. The isolation valve of claim 15, wherein the rod includes a seal at each end configured to sealingly engage the piston bore.

17. An isolation valve for use with a tubular string, comprising:

a tubular housing for connection with the tubular string;

a closure member disposed in the housing and movable between an open position and a closed position;

a flow tube longitudinally movable relative to the housing for opening the closure member;

a flow tube piston for moving the flow tube;

a fluid chamber formed between the flow tube and the housing and receiving the piston;

a first fluid passage for fluid communication between a first portion of the chamber and a control line and for moving the flow tube piston in a first direction;

a floating piston disposed in a second portion of the chamber; and a biasing member disposed in a second portion for moving the flow tube piston in a second direction, wherein the biasing member is disposed between the floating piston and the flow tube piston.

18. The isolation valve of claim 17, wherein one side of the floating piston is coupled to the biasing member and an opposite side of the floating piston is exposed to a hydrostatic pressure.

19. An isolation valve, comprising:

a tubular housing;

a closure member disposed in the housing and movable between an open position and a closed position;

a flow tube longitudinally movable relative to the housing for opening the closure member;

a piston for moving the flow tube;

a hydraulic chamber formed between the flow tube and the housing and receiving the piston, wherein the piston separates the chamber into a first portion and a second portion;

a first hydraulic passage for fluid communication between the first portion of the chamber and a control line and for moving the piston in a first direction; and a biasing member disposed in the second portion of the chamber for moving the piston in a second direction, wherein the second portion of the chamber is sealed from a bore of the isolation valve.

20. The isolation valve of claim 19, wherein a pressure in the second portion of the chamber is preset at atmospheric pressure.

* * * * *